US007636010B2

(12) United States Patent
Huang

(10) Patent No.: US 7,636,010 B2
(45) Date of Patent: Dec. 22, 2009

(54) PROCESS INDEPENDENT CURVATURE COMPENSATION SCHEME FOR BANDGAP REFERENCE

(75) Inventor: Chi-Chia Huang, Taipei (TW)

(73) Assignee: Elite Semiconductor Memory Technology Inc., Hsinchu (TW)

( * ) Notice: Subject to any disclaimer, the term of this patent is extended or adjusted under 35 U.S.C. 154(b) by 50 days.

(21) Appl. No.: 12/117,741

(22) Filed: May 9, 2008

(65) Prior Publication Data

US 2009/0058512 A1 Mar. 5, 2009

Related U.S. Application Data

(60) Provisional application No. 60/969,650, filed on Sep. 3, 2007.

(51) Int. Cl.
*G05F 1/10* (2006.01)

(52) U.S. Cl. ..... 327/539

(58) Field of Classification Search ..... 327/513, 327/534, 535, 537, 539
See application file for complete search history.

(56) References Cited

U.S. PATENT DOCUMENTS

| | | | | |
|---|---|---|---|---|
| 5,952,873 | A | 9/1999 | Rincon-Mora | |
| 6,225,796 | B1 | 5/2001 | Nguyen | |
| 6,255,807 | B1 | 7/2001 | Doorenbos et al. | |
| 7,215,183 | B2 * | 5/2007 | Nakada | 327/539 |
| 7,224,210 | B2 * | 5/2007 | Garlapati et al. | 327/539 |
| 7,286,002 | B1 * | 10/2007 | Jackson | 327/539 |

* cited by examiner

*Primary Examiner*—Jeffrey S Zweizig
(74) *Attorney, Agent, or Firm*—Jianq Chyun IP Office

(57) ABSTRACT

In a voltage reference circuit, a bandgap reference circuit, for generating a bandgap reference voltage and a reference current, includes an operation amplifier, and a first transistor for providing the reference current. Another transistor mirrors the reference current to provide a first current. A compensation controller converts a node voltage from the bandgap reference circuit into a second current and performs current subtraction on the first current and the second current to provide a compensation feedback current to another node of the bandgap reference circuit. So that, second order temperature compensation is performed on the bandgap reference voltage.

17 Claims, 7 Drawing Sheets

PROCESS INDEPENDENT CURVATURE COMPENSATION SCHEME FOR BANDGAP REFERENCE

CROSS-REFERENCE TO RELATED APPLICATION

This application claims the priority benefit of U.S.A. provisional application Ser. No. 60969650, filed on Sep. 3, 2007. The entirety of the above-mentioned patent application is hereby incorporated by reference herein and made a part of specification.

BACKGROUND OF THE INVENTION

1. Field of Invention

The present invention relates to a voltage reference circuit with 2nd order temperature compensation.

2. Description of Related Art

Reference circuits are necessarily present in many applications, such as purely analog, mixed-mode, to purely digital circuits. The demand for low voltage references is especially apparent in mobile battery operated products, such as cellular phones, pagers, camera recorders, and laptops. Consequently, low voltage and low quiescent current flow are required characteristics for improving battery efficiency and longevity. Low voltage operation is a consequence of improved process technology. Unfortunately, lower dynamic range (a consequence of low voltage) demands that reference voltages be more accurate.

Voltage references are generally required to provide a substantially constant output voltage despite gradual or momentary changes in input voltage, output current or temperature. In particular, many designers have utilized bandgap reference circuits due to their ability to provide a stable voltage supply that is insensitive to temperature variations over a wide temperature range. These bandgap references rely on certain temperature-dependent characteristics of the base-emitter voltage Vbe of a BJT transistor. Typically, these bandgap reference circuits operate on the principle of compensating the negative temperature coefficient of a bipolar transistor's base-emitter voltage with the positive temperature coefficient of the thermal voltage, i.e., with $V_{Thermal}$=kT/q, where k is Boltzmann's constant, T is the absolute temperature in degrees Kelvin, and q is the electronic charge. In general, the negative temperature coefficient of the base-emitter voltage is summed with the positive temperature coefficient of the thermal voltage $V_{Thermal}$, which is appropriately scaled such that the resultant summation provides a zero temperature coefficient.

While the bandgap reference is ideally desired to be independent of temperature, or at least linear with temperature, in practice the bandgap reference will typically produce a reference voltage only to be independent of temperature in a given range of temperature. This characteristic of the bandgap reference is mainly due to the fact that the Vbe (T) term is a non-linear function. In other words, an inherent variation exists for the base-emitter voltage Vbe of a transistor with respect to temperature. In particular, the bandgap reference generates a strong second-order term that varies with T ln(T), and which limits the temperature drift performance of such a reference, i.e., causes deviation of the reference voltage with temperature. While these second order terms may be relatively small, their impact can prove highly undesirable for many applications.

Various methods have been used to compensate for the temperature curvature characteristics for bandgap references.

These methods have included the addition of circuitry which first attempts to measure the temperature curvature of the base-emitter voltage Vbe, and then sum the measured temperature curvature term with the bandgap reference output. Other methods have included the addition of circuitry that approximates the temperature curvature with a squared function of the temperature, such as by utilizing a proportional-to-absolute-temperature (PTAT) current through a resistor having a given temperature coefficient TC. While these methods may be utilized with some success, limitations exist over process availability and process variations. Most notably, many of these methods have been configured to address applications utilizing bipolar transistors, but can not be utilized effectively with CMOS applications. This limitation of prior art methods results from that the parasitic vertical bipolar transistor available in standard CMOS process has its collector always connected to substrate and limits the use of vertical bipolar transistor as an emitter follower.

FIG. 1 shows a conventional reference circuit having mixed current and voltage-mode architecture. FIG. 2 is a graph showing the temperature dependence of the reference circuit of FIG. 1.

As shown in FIG. 1, a bandgap circuit 16 utilizes a current-mode approach with a voltage-mode ladder. The bandgap circuit 16 includes series connected current source $AI_{Vbe}$ and resistors R13, R12, and R11 coupled between a voltage source V and GND. Bandgap reference voltage Vref is produced at node between current source $AI_{Vbe}$ and resistor R13. Current source $BI_{PTAT}$ is coupled between voltage source V and node a between resistors R13 and R12. Current source $CI_{NL}$ is coupled between voltage source V and node b between resistors R12 and R11.

The resulting relation of the reference voltage Vref can be described by:

$$\text{Vref}=AI_{Vbe}*(R11+R12+R13)+BI_{PTAT}*(R11+R12)+CI_{NL}*R11$$

where $I_{Vbe}$, $I_{PTAT}$, and $I_{NL}$ correspond to the base-emitter, PTAT, and nonlinear temperature dependent currents respectively.

The curvature corrected bandgap of FIG. 1 has a temperature dependence as illustrated in FIG. 2. It achieved a temperature drift of 8.6 μV/° C. (−15° C. to 90° C.).

However, $I_{Vbe}$ and $I_{PTAT}$ are not directly related. Besides, due to process variation, $I_{Vbe}$ may be larger than expected. So, $I_{NL}$ is smaller than expected (i.e. $I_{NL}$ may be process dependent). In fact, when $I_{Vbe}$ is larger than expected, Vref will suffer faster decay with increasing temperature and a larger $I_{NL}$ is required to compensate for $I_{Vbe}$. However, actually, $I_{NL}$ just moves in the opposite way and worsens offset of the bandgap reference voltage.

FIG. 3 shows another bandgap reference circuit 300 having amplifier 304, for example a dual differential amplifier. In addition, amplifier 304 is suitably configured such that one pair of differential inputs are suitably coupled to transistors 305 and 306 and resistors 301, 302 and 303. Further, the second pair of differential inputs of amplifier 304 can be suitably coupled to two transistors having different temperature coefficients, such as 306 having a PTAT/R current and 307 having a Vbe/R current. Accordingly, one pair of differential inputs can receive a voltage reference, while the second pair of differential inputs can receive a temperature curvature compensation voltage, i.e., one having a Tln(T) term. As a result of the feedback arrangement, any offset voltage realized by the second differential pair will be inverted and realized by the first differential pair, with or without suitable scaling by the effective gm contributions within dual differential amplifier 304, to provide a temperature compensated reference voltage Vout.

However, too many BJT transistors are used to implement the architecture of FIG. 3 and accordingly matching between BJT transistors is poor. In addition, with the same percentage of decrease in R301/R302/R303, increase in $V_{E3}$ (emitter voltage of the transistor 307) is larger than that in $V_{E2}$ (emitter voltage of the transistor 306). So, curvature compensation effect provided by the architecture of FIG. 3 is process sensitive, which is undesirable. Further, as for the dual differential pairs in the OP 304, 4 PMOS transistors have to be matched well, which is difficult because each pair has its own N-well.

Therefore, a high precision and trim-free bandgap circuit with process independent curvature compensation scheme is preferred.

SUMMARY OF THE INVENTION

The invention is related to a voltage reference circuit, which is compensated by process independent curvature compensation scheme (CCS).

The invention is related to a voltage reference circuit, wherein the input signals into the compensation circuit come from the bandgap reference circuit, so that the compensation is process independent.

The invention is related to a voltage reference circuit, wherein the layout matching and process matching are easy.

The invention is related to a hybrid topology to compensate bandgap reference voltage generated from a voltage reference circuit.

The invention is related to a voltage reference circuit compensated by CCS which is built in a feedback topology to enhance the regulation capability.

One example of the invention provides a voltage reference circuit. The voltage reference circuit includes: a bandgap reference circuit for generating a bandgap reference voltage and a reference current, a first node and a second node of the bandgap reference circuit being between the bandgap reference voltage and a negative temperature coefficient voltage, the bandgap reference circuit at least including a first operation amplifier having an output terminal, and a first transistor having a first terminal coupled to a power supply, a second terminal coupled to the bandgap reference voltage and a control terminal coupled to the output terminal of the first operation amplifier; a second transistor having a first terminal coupled to the power supply, a second terminal for mirroring the reference current from the bandgap reference circuit to provide a first current and a control terminal coupled to the output terminal of the first operation amplifier; and a compensation controller, coupled to the bandgap reference circuit, the compensation controller converting a node voltage of the second node into a second current and performing current subtraction on the first current and the second current to provide a compensation feedback current to the first node of the bandgap reference circuit, so that the bandgap reference voltage being temperature compensated.

Another example of the invention provides a voltage reference circuit including: a bandgap reference circuit for generating a bandgap reference voltage and a reference current, a first node of the bandgap reference circuit being between the bandgap reference voltage and a first negative temperature coefficient voltage, a second node of the bandgap reference circuit being between the bandgap reference voltage and a second negative temperature coefficient voltage, the bandgap reference circuit at least including a first operation amplifier having an output terminal, and a first transistor having a first terminal coupled to a power supply, a second terminal coupled to the bandgap reference voltage and a control terminal coupled to the output terminal of the first operation amplifier; a second transistor having a first terminal coupled to the power supply, a second terminal for mirroring the reference current from the bandgap reference circuit to provide a first current and a control terminal coupled to the output terminal of the first operation amplifier; a compensation controller, coupled to the bandgap reference circuit, the compensation controller converting a node voltage of the second node into a second current and performing current subtraction on the first current and the second current to provide a first compensation feedback current; and a current inverter, coupled to the bandgap reference circuit and the compensation controller, for inverting the first compensation feedback current from the compensation controller into a second compensation feedback current, the second compensation feedback current being fed back to the first node of the bandgap reference circuit, so that the bandgap reference voltage being temperature compensated.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
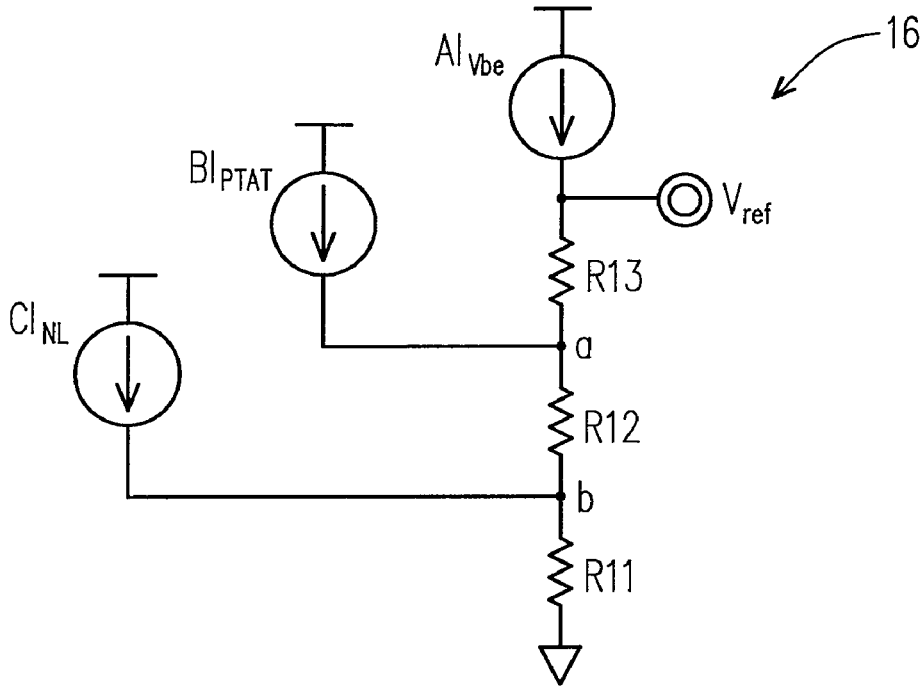
FIG. 1 (PRIOR ART)
FIG. 1 shows a conventional reference circuit having mixed current and voltage-mode architecture.
Figure 2:
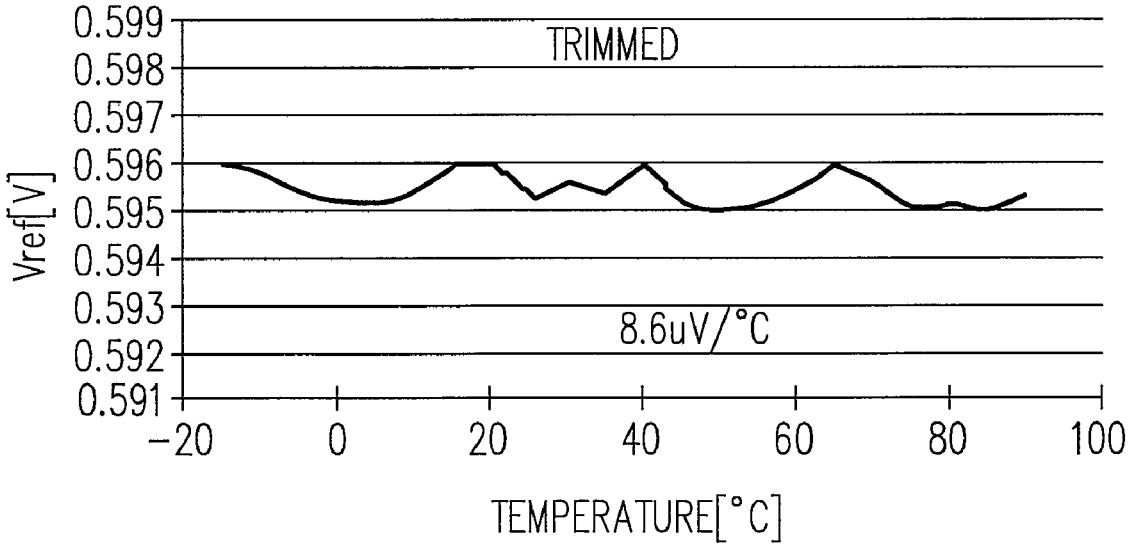
FIG. 2 (PRIOR ART)
FIG. 2 is a graph showing the temperature dependence of the reference circuit of FIG. 1.
Figure 3:
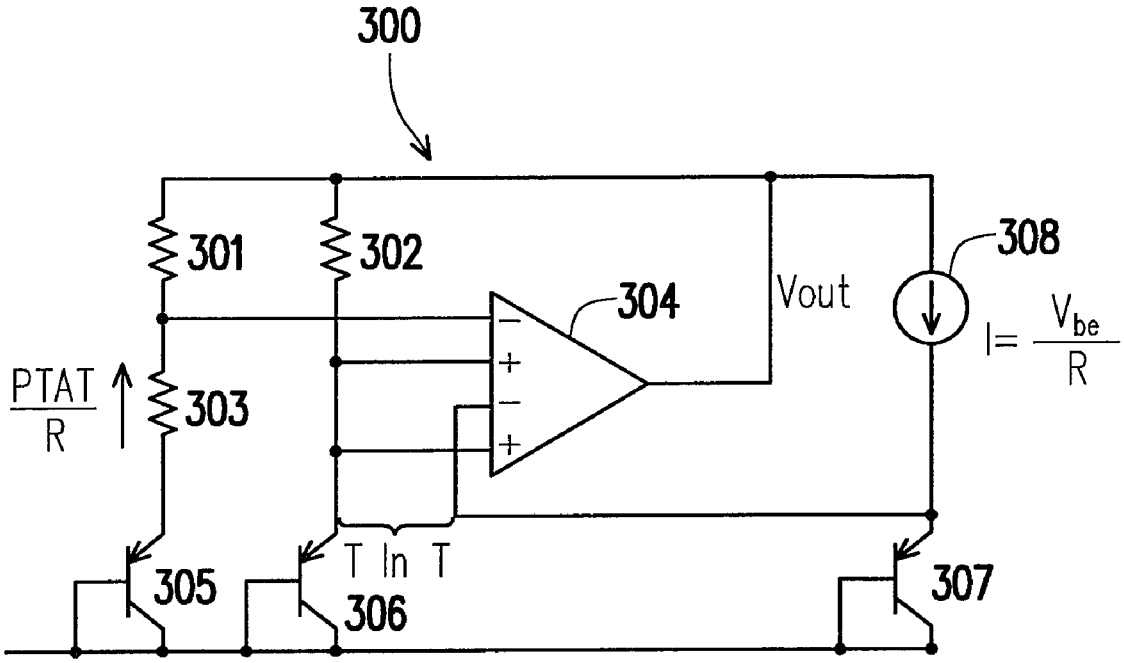
FIG. 3 (PRIOR ART)
FIG. 3 shows another conventional bandgap reference circuit.

Reference will now be made in detail to the present embodiments of the invention, examples of which are illustrated in the accompanying drawings. Wherever possible, the same reference numbers are used in the drawings and the description to refer to the same or like parts.

In embodiments of the invention, a temperature dependent but process independent factor is introduced into voltage reference circuits.

First Embodiment

Figure 4:
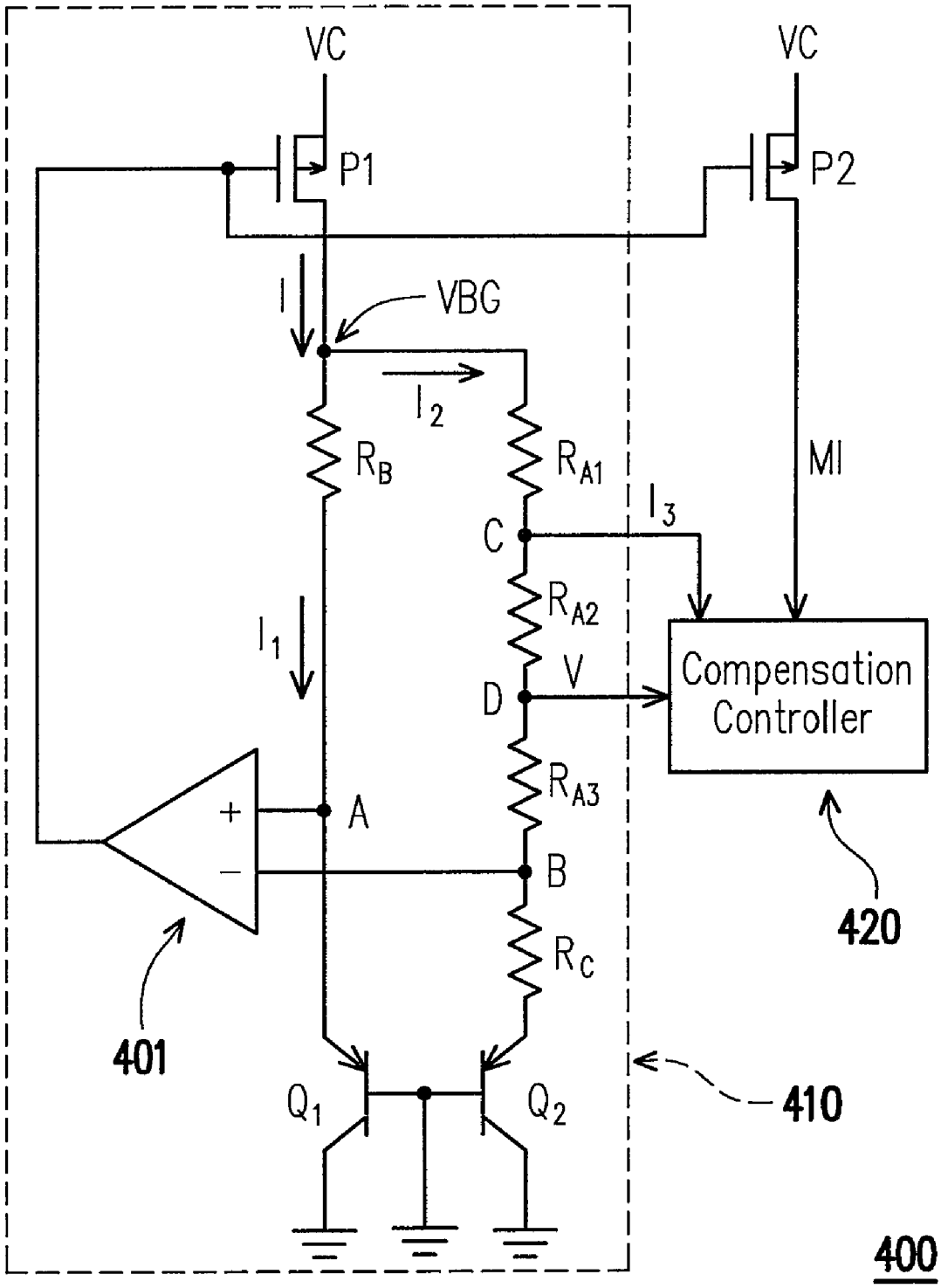
FIG. 4 shows a voltage reference circuit according to a first embodiment of the invention.

FIG. 4 shows a voltage reference circuit according to a first embodiment of the invention. As shown in FIG. 4, the voltage reference circuit 400 includes: a bandgap reference circuit 410, a compensation controller 420 and a PMOS transistor P2. The bandgap reference circuit 410 is for generating a bandgap reference voltage VBG and a reference current I. The compensation controller 420 is coupled to the bandgap reference circuit 410 and the transistor P2. The compensation controller 420 converts a node voltage V at node D into a current N1Ic and performs current subtraction on the current MI (from the transistor P2) and the current N1Ic to provide a compensation feedback current I3 to node C of the bandgap reference circuit 410. So that, the bandgap reference voltage VBG is temperature compensated.

The bandgap reference circuit 410 includes: an operation amplifier 401, a PMOS transistor P1, BJT transistors Q1 and Q2, and resistors $R_{A1}$, $R_{A2}$, $R_{A3}$, $R_B$ and Rc. Resistors $R_{A1}$, $R_{A2}$, $R_{A3}$, $R_B$ and Rc are of the same type. Current I1 flow through the resistor $R_B$ and Current I2 flow through the resistor $R_{A1}$. Nodes A and B are coupled to the operation amplifier 401.

Node C and node D are between the bandgap reference voltage VBG and a negative temperature coefficient voltage (emitter-base voltage $V_{EB2}$ of the transistor Q2).

The operation amplifier 401 has: two input terminals coupled to the node A and the node B respectively; and an output terminal coupled to the transistors P1 and P2.

The transistor P1 has a source terminal coupled to a power supply VC, a drain terminal coupled to the bandgap reference voltage VBG and a gate terminal coupled to the output terminal of the operation amplifier 401.

The second transistor P2 has a source terminal coupled to the power supply VC, a drain terminal coupled to the compensation controller 420 and a gate terminal coupled to the output terminal of the operation amplifier 401. The transistors P1 and P2 form a current mirror for mirroring the reference current in the bandgap reference circuit 410 to provide a current MI to the compensation controller 420.

In the first embodiment, the temperature dependent but process independent factor K is defined as:

$$K = \frac{I3}{I} = \frac{K5 * V_{EB1} - K6 * V_{EB2}}{K1 * V_{EB1} - K2 * V_{EB2}},\ K > 0 \tag{1}$$

K1, K2, K5 and K6 are all constants and $V_{EB1}$ and $V_{EB2}$ are emitter-base voltages of the transistors Q1 and Q2. If other nodes are chose to provide the voltage signal V, then K1, K2, K5 and K6 may be varied accordingly.

The bandgap reference voltage VBG is expressed by:

$$\begin{aligned} VBG &= V_{EB1} + V_T \frac{R_A}{R_C} \ln \frac{R_A}{R_B}\left[1 + \frac{KR_{A1}(R_A + R_B)}{R_A(R_B - K(R_{A1} + R_B)}\right] \\ &= V_{EB1} + V_T \frac{R_A}{R_C} \ln \frac{R_A}{R_B}\left[\frac{1}{1 - K\left(1 + \frac{R_{A1}}{R_B}\right)}\right] \end{aligned} \tag{2}$$

In equation (2), $R_A = R_{A1} + R_{A2} + R_{A3}$.

As known, $V_{EB1}$ is a NTC (negative temperature coefficient) voltage and $V_T$ is a PTAT voltage.

Coefficient term (i.e.

$$\frac{R_A}{R_C} \ln \frac{R_A}{R_B}\left[\frac{1}{1 - K\left(1 + \frac{R_{A1}}{R_B}\right)}\right]$$

of $V_T$, which is process independent and is a second order compensation coefficient, can be modified by K.

Boundary condition for convergence is, $$K\left(1 + \frac{R_{A1}}{R_B}\right) < 1.$$

Therefore, K is only sensitive to $V_{EB1}$ and $V_{EB2}$. With good layout matching, $V_{EB1}$ and $V_{EB2}$ will move in the same direction with the same percentage even if process has variation. Further, effect of $V_{EB1}$ and $V_{EB2}$ on K will be removed in first order because they appear both in nominator and denominator.

Figure 5:
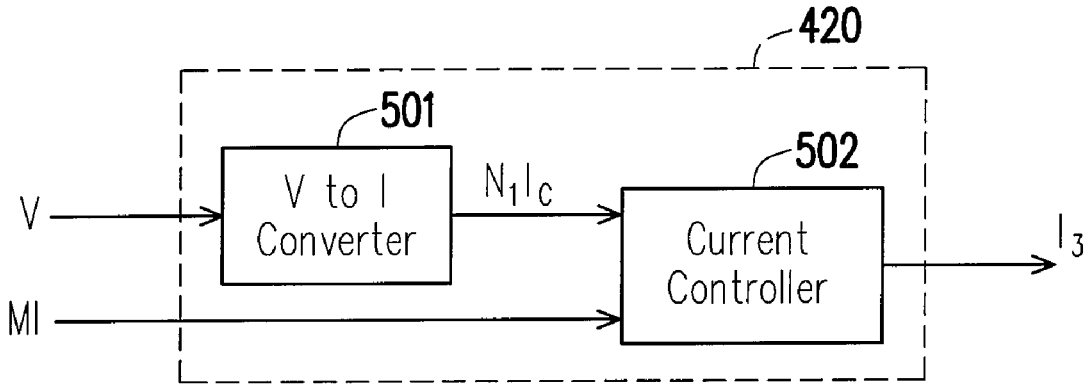
FIG. 5 shows the compensation controller of the voltage reference circuit in FIG. 4.

As shown in FIG. 5, the compensation controller 420 includes: a voltage-to-current converter 501 and current controller 502. The voltage-to-current converter 501 for converting the node voltage V at the node D of the bandgap reference circuit 140 into the current N1Ic. The current controller 502 is for performing current subtraction on the current MI and the current N1Ic to provide the compensation feedback current I3.

Figure 6:
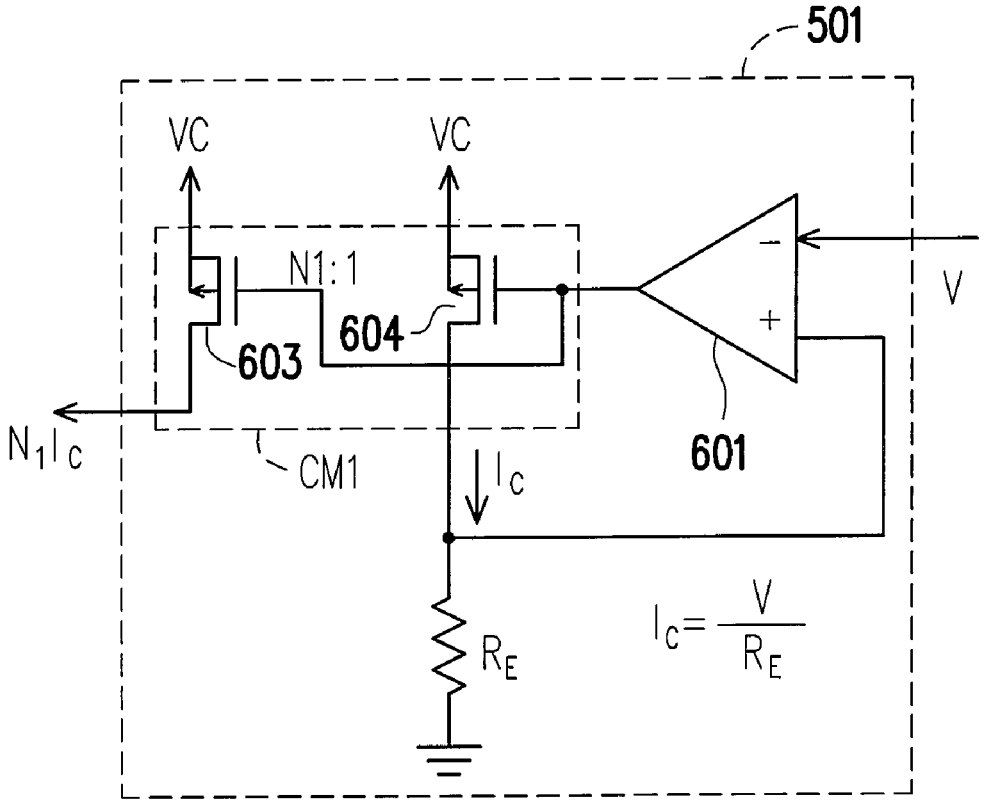
FIG. 6 shows the voltage-to-current converter of the compensation controller in FIG. 5.

Now, please refer to FIG. 6, which shows the voltage-to-current converter 501. The voltage-to-current converter 501 includes: an operation amplifier 601, a resistor $R_E$ and a current mirror CM1. Resistor $R_E$ is of the same type as resistors $R_{A1}$, $R_{A2}$, $R_{A3}$, $R_B$ and Rc in the bandgap reference circuit 410.

The operation amplifier 601 has a first input terminal for being coupled to the node D of the bandgap reference circuit 410, a second input terminal coupled to the resistor $R_E$, and an output terminal coupled to the current mirror CM1.

The resistor $R_E$ has a first terminal coupled to the second input terminal of the operation amplifier 601 and a second terminal coupled to GND. Due to the operation amplifier 601, $Ic = V/R_E$.

The current mirror CM1 is coupled to the operation amplifier 601 and the resistor $R_E$, for mirroring a current Ic flowing through the resistor $R_E$ to provide the current N1Ic. The current mirror CM1 includes: transistors 603 and 604.

The transistor 604 has a source terminal coupled to the power supply, a drain terminal coupled to the second input terminal of the operation amplifier 601 and the resistor $R_E$, and a gate terminal coupled to the output terminal of the operation amplifier 601.

The transistor 603 has a source terminal coupled to the power supply, a drain terminal for providing the current N1Ic, and a gate terminal coupled to the output terminal of the operation amplifier 601. The size ratio of the transistors 603 to 604 is N1:1.

Figure 7:
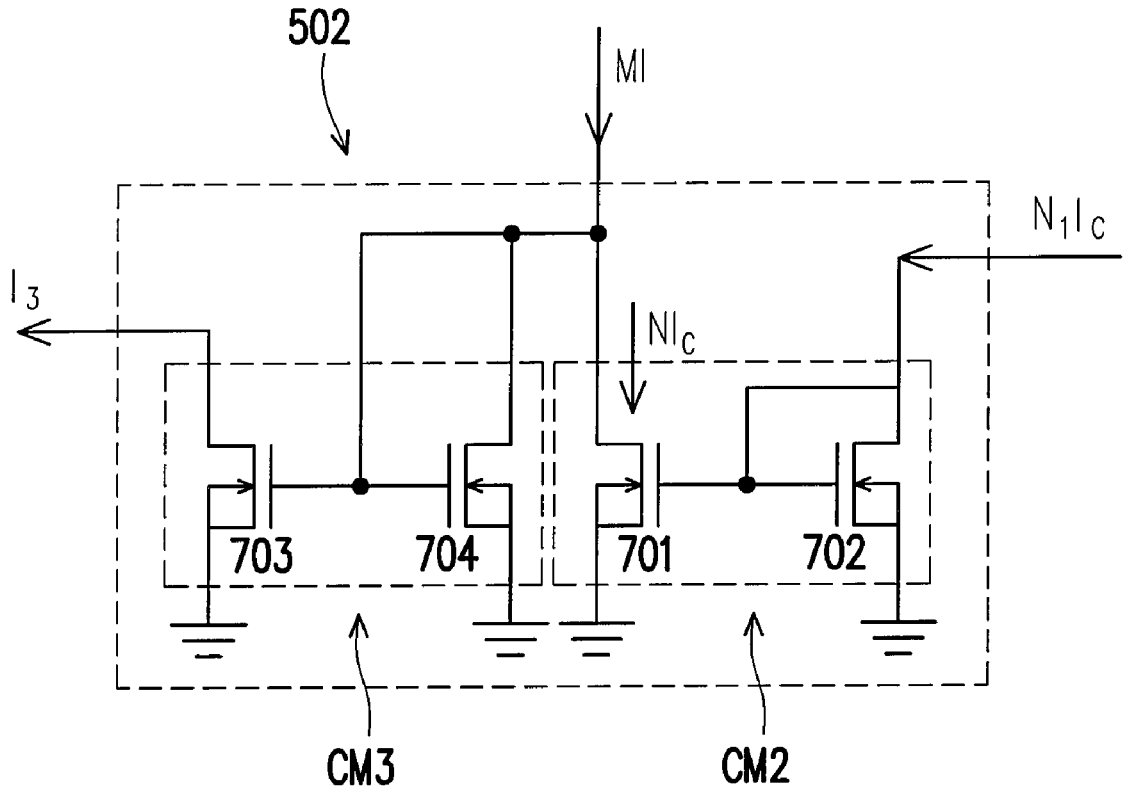
FIG. 7 shows the current controller of the compensation controller in FIG. 5.

FIG. 7 shows the current controller 502. The current controller 502 includes current mirrors CM2 and CM3. The current mirror CM2 is coupled to the voltage-to-current converter 501 and the transistor P2, for mirroring the current N1Ic to provide a fourth current NIc. The current mirror CM3 is coupled to the second transistor P2, the current mirror CM2 and the bandgap reference circuit 410, for mirroring a current MI-NIc to provide the compensation feedback current I3 back to the node C of the bandgap reference circuit 410.

The current mirror CM2 includes: transistors 701 and 702. The transistor 701 has a source terminal coupled to GND, a drain terminal coupled to the drain terminal of the transistor P2, and a gate terminal coupled to the transistor 702. The transistor 702 has a source terminal coupled to GND, a drain terminal coupled to the current N1Ic, and a gate terminal coupled to the gate terminal of the transistor 701 and the drain terminal thereof. The size ratio of the transistor 701 to 702 is N:N1.

The current mirror CM3 includes: transistors 703 and 704. The transistor 703 has a source terminal coupled to GND, a drain terminal for providing the compensation feedback current I3 to the node C of the bandgap reference circuit 410, and a gate terminal coupled to the transistor 704. The transistor 704 has a source terminal coupled to GND, a drain terminal coupled to the second transistor P2 and the drain terminal of the transistor 701, and a gate terminal coupled to the gate terminal of the transistor 703 and the drain terminal thereof.

Now please refer to FIG. 4 again. The feedback current I3, which is used to compensate the bandgap reference voltage VBG, is obtained based on node voltage V and node current I of the bandgap reference circuit 410. The node voltage V is coupled between the bandgap reference voltage VBG and a NTC voltage ($V_{EB2}$ of the transistor Q2).

In the first embodiment, the node D, which provides voltages to the compensation controller 420, is between the bandgap reference voltage VBG and a NTC voltage (i.e. $V_{EB2}$ of the transistor Q2). Of course, other nodes between the bandgap reference voltage VBG and the NTC voltage may be chose to provide voltages to the compensation controller 420.

Besides, the node C, which receives the compensation feedback current I3, is between the bandgap reference voltage VBG and the NTC voltage (i.e. $V_{EB2}$ of the transistor Q2). Of course, other nodes between the bandgap reference voltage VBG and the NTC voltage may be chose to receives the compensation feedback current I3.

Second Embodiment

Figure 8:
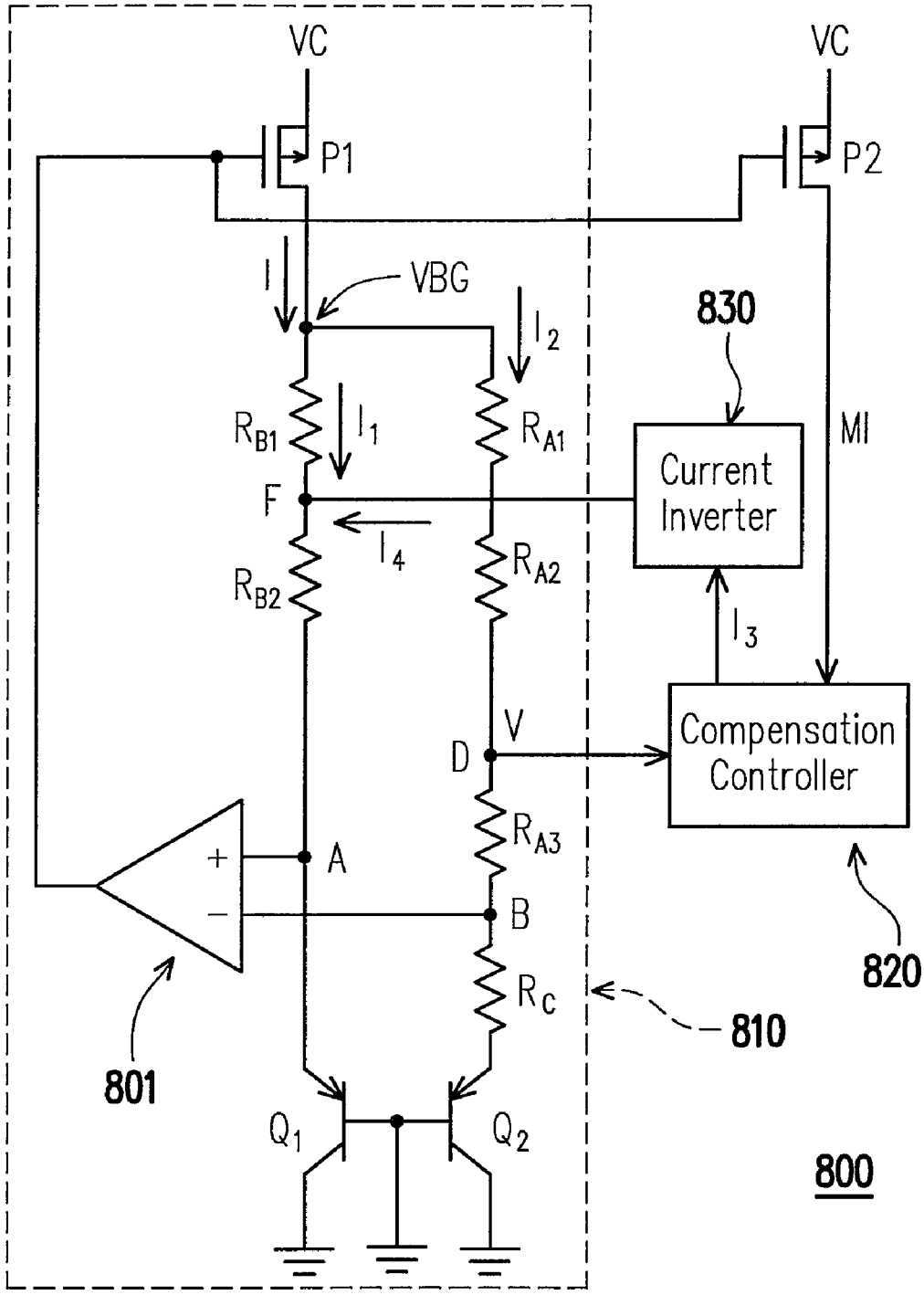
FIG. 8 shows a voltage reference circuit according to a second embodiment of the invention.

FIG. 8 shows a voltage reference circuit according to a second embodiment of the invention. As shown in FIG. 8, the voltage reference circuit 800 includes: a bandgap reference circuit 810, a compensation controller 820, a current inverter 830 and a PMOS transistor P2. The bandgap reference circuit 810, the compensation controller 820 and the PMOS transistor P2 in the second embodiment may be similar or the same as the bandgap reference circuit 410, the compensation controller 420 and the PMOS transistor P2 in the first embodiment and accordingly the details thereof are omitted here.

In the bandgap reference circuit 810, the node F, which provides node voltage V to the compensation controller 820, is between the bandgap reference voltage VBG and a negative temperature coefficient (NTC) voltage $V_{EB1}$ of the transistor Q1. Besides, the node D of the bandgap reference circuit 810, which receives compensation current I4 from the current inverter 830, is between the bandgap reference voltage VBG and another NTC voltage ($V_{EB2}$ of the transistor Q2). $R_{B1}$ and $R_{B2}$ refer to resistors.

The current inverter 830 is coupled to the bandgap reference circuit 810 and the compensation controller 820, for inverting the compensation feedback current I3 from the compensation controller 820 into another compensation feedback current I4. The compensation feedback current I4 is fed back to the node F of the bandgap reference circuit 810, so that the bandgap reference voltage VBG is temperature compensated.

In the second embodiment, the node D, which provides voltages to the compensation controller 820, is between the bandgap reference voltage VBG and a NTC voltage $V_{EB2}$ of the transistor Q2. Of course, other nodes between the bandgap reference voltage VBG and a NTC voltage may be chose to provide voltages to the compensation controller 820.

Besides, the node F, which receives the compensation feedback current I4, is between the bandgap reference voltage VBG and another NTC voltage (i.e. $V_{EB1}$ of the transistor Q1). Of course, other nodes between the bandgap reference voltage VBG and the NTC voltage may be chose to receive the compensation feedback current I4.

The bandgap reference voltage VBG generated from FIG. 8 may have similar expression as the equation (2).

Figure 9:
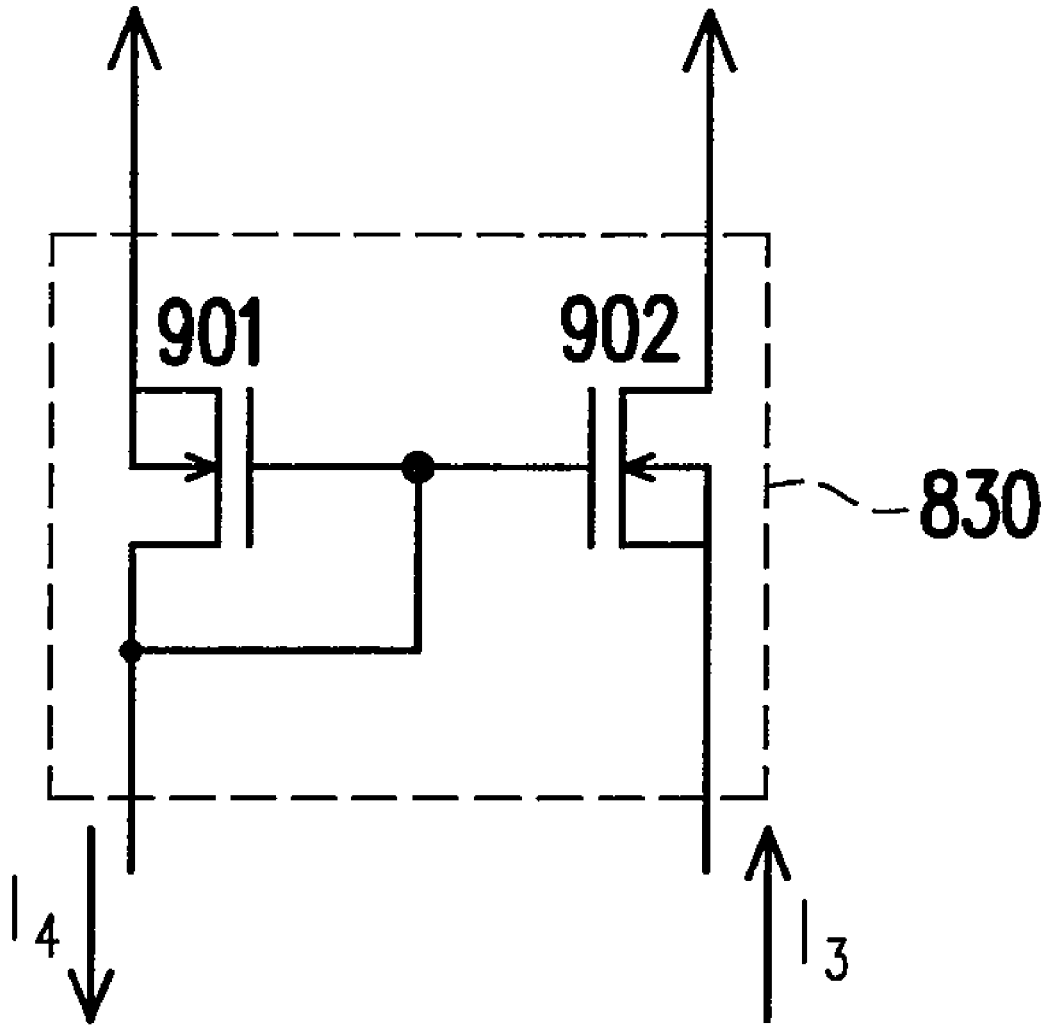
FIG. 9 shows the current inverter of the voltage reference circuit in FIG. 8.

FIG. 9 shows the current inverter 830. The current inverter 830 includes transistors 901 and 902. The transistor 901 has a source terminal coupled to the power supply, a drain terminal for providing the compensation feedback current I4 to the bandgap reference circuit 810, and a gate terminal coupled to the transistor 902 and the drain terminal thereof. The transistor 902 has a source terminal coupled to the power supply, a drain terminal coupled to the compensation feedback current I3 from the compensation controller 820 and a gate terminal coupled to the gate terminal and the drain terminal of the transistor 901.

In sum, the curvature compensation scheme as disclosed in the above embodiment of the invention is process independent because, (1) the input signals (V and I of FIG. 4 and FIG. 8) into the compensation controller come from the bandgap reference circuit; (2) all resistors are of the same type; (3) effect comes from process variation of bipolar transistor is removed in first order. Other features of the above embodiment of the invention include (1) applicable to standard CMOS process; (2) the layout matching and process matching are easy; (3) the curvature compensation scheme (CCS) used in the embodiments is hybrid (with voltage signals and current signals); (4) CCS is built in a feedback topology to enhance the regulation capability.

It will be apparent to those skilled in the art that various modifications and variations can be made to the structure of the present invention without departing from the scope or spirit of the invention. In view of the foregoing descriptions, it is intended that the present invention covers modifications and variations of this invention if they fall within the scope of the following claims and their equivalents.

What is claimed is:

1. A voltage reference circuit comprising:

a bandgap reference circuit for generating a bandgap reference voltage and a reference current, a first node and a second node of the bandgap reference circuit being between the bandgap reference voltage and a negative temperature coefficient voltage, the bandgap reference voltage at least including: a first operation amplifier having an output terminal; and a first transistor having a first terminal coupled to a power supply, a second terminal coupled to the bandgap reference voltage and a control terminal coupled to the output terminal of the first operation amplifier;

a second transistor having a first terminal coupled to the power supply, a second terminal for mirroring the reference current from the bandgap reference circuit to provide a first current and a control terminal coupled to the output terminal of the first operation amplifier; and a compensation controller, coupled to the bandgap reference circuit, the compensation controller converting a node voltage of the second node into a second current and performing current subtraction on the first current and the second current to provide a compensation feedback current to the first node of the bandgap reference circuit, so that the bandgap reference voltage being temperature compensated.

2. The voltage reference circuit of claim 1, wherein the compensation controller includes:

a voltage-to-current converter, for converting the node voltage of the second node into the second current; and a current controller, for performing current subtraction on the first current and the second current to provide the compensation feedback current.

3. The voltage reference circuit of claim 2, wherein the voltage-to-current converter includes:

a second operation amplifier, having a first input terminal for being coupled to the second node of the bandgap reference circuit, a second input terminal, and an output terminal;

a first resistor, having a first terminal coupled to the second input terminal of the second operation amplifier, and a second terminal coupled to GND; and a first current mirror, coupled to the second operation amplifier and the first resistor, for mirroring a third current flowing through the first resistor to provide the second current.

4. The voltage reference circuit of claim 3, wherein the first current mirror includes:

a third transistor, having a first terminal coupled to the power supply, a second terminal coupled to the second input terminal of the second operation amplifier and the first terminal of the first resistor, and a control terminal coupled to the output terminal of the second operation amplifier; and a fourth transistor, having a first terminal coupled to the power supply, a second terminal for providing the second current, and a control terminal coupled to the output terminal of the second operation amplifier.

5. The voltage reference circuit of claim 2, wherein the current controller includes:

a second current mirror, coupled to the voltage-to-current converter and the second terminal of the second transistor, for mirroring the second current to provide a fourth current; and a third current mirror, coupled to the second terminal of the second transistor, the second current mirror and the bandgap reference circuit, for mirroring a current subtraction of the first current and the fourth current to provide the compensation feedback current to the first node of the bandgap reference circuit.

6. The voltage reference circuit of claim 5, wherein the second current mirror includes:

a fifth transistor, having a first terminal coupled to GND, a second terminal coupled to the second terminal of the second transistor, and a control terminal; and a sixth transistor, having a first terminal coupled to GND, a second terminal coupled to the second current, and a control terminal coupled to the control terminal of the fifth transistor and the second terminal of the sixth transistor.

7. The voltage reference circuit of claim 5, wherein the third current mirror includes:

a seventh transistor, having a first terminal coupled to GND, a second terminal for providing the compensation feedback current to the first node of the bandgap reference circuit, and a control terminal; and an eighth transistor, having a first terminal coupled to GND, a second terminal coupled to the second terminal of the second transistor, and a control terminal coupled to the control terminal of the seventh transistor and the second terminal of the eighth transistor.

8. The voltage reference circuit of claim 1, wherein the negative temperature coefficient voltage is provided by a ninth transistor configured in the bandgap reference circuit.

9. A voltage reference circuit comprising:

a bandgap reference circuit for generating a bandgap reference voltage and a reference current, a first node of the bandgap reference circuit being between the bandgap reference voltage and a first negative temperature coefficient voltage, a second node of the bandgap reference circuit being between the bandgap reference voltage and a second negative temperature coefficient voltage, the bandgap reference circuit at least including: a first operation amplifier having an output terminal; and a first transistor having a first terminal coupled to a power supply, a second terminal coupled to the bandgap reference voltage and a control terminal coupled to the output terminal of the first operation amplifier;

a second transistor having a first terminal coupled to the power supply, a second terminal for mirroring the reference current from the bandgap reference circuit to provide a first current and a control terminal coupled to the output terminal of the first operation amplifier;

a compensation controller, coupled to the bandgap reference circuit, the compensation controller converting a node voltage of the second node into a second current and performing current subtraction on the first current and the second current to provide a first compensation feedback current; and a current inverter, coupled to the bandgap reference circuit and the compensation controller, for inverting the first compensation feedback current from the compensation controller into a second compensation feedback current, the second compensation feedback current being fed back to the first node of the bandgap reference circuit, so that the bandgap reference voltage being temperature compensated.

10. The voltage reference circuit of claim 9, wherein the compensation controller includes:

a voltage-to-current converter, for converting the node voltage of the second node into the second current; and a current controller, for performing current subtraction on the first current and the second current to provide the first compensation feedback current.

11. The voltage reference circuit of claim 10, wherein the voltage-to-current converter includes:

a second operation amplifier, having a first input terminal coupled to the second node of the bandgap reference circuit, a second input terminal, and an output terminal;

a first resistor, having a first terminal coupled to the second input terminal of the second operation amplifier, and a second terminal coupled to GND; and a first current mirror, coupled to the second operation amplifier and the first resistor, for mirroring a third current flowing through the first resistor to provide the second current.

12. The voltage reference circuit of claim 11, wherein the first current mirror includes:

a third transistor, having a first terminal coupled to the power supply, a second terminal coupled to the second input terminal of the second operation amplifier and the first terminal of the first resistor, and a control terminal coupled to the output terminal of the second operation amplifier; and a fourth transistor, having a first terminal coupled to the power supply, a second terminal for providing the second current, and a control terminal coupled to the output terminal of the second operation amplifier.

13. The voltage reference circuit of claim 10, wherein the current controller includes:

a second current mirror, coupled to the voltage-to-current converter and the second terminal of the second transistor, for mirroring the second current to provide a fourth current; and a third current mirror, coupled to the second terminal of the second transistor, the second current mirror and the bandgap reference circuit, for mirror a current subtraction of the first current and the fourth current to provide the first compensation feedback current to the current inverter.

14. The voltage reference circuit of claim 13, wherein the second current mirror includes:

a fifth transistor, having a first terminal coupled to GND, a second terminal coupled to the second terminal of the second transistor, and a control terminal; and a sixth transistor, having a first terminal coupled to GND, a second terminal coupled to the second current, and a control terminal coupled to the control terminal of the fifth transistor and the second terminal of the sixth transistor.

15. The voltage reference circuit of claim 13, wherein the third current mirror includes:

a seventh transistor, having a first terminal coupled to GND, a second terminal for providing the first compensation feedback current to the current inverter, and a control terminal; and an eighth transistor, having a first terminal coupled to GND, a second terminal coupled to the second terminal of the second transistor, and a control terminal coupled to the control terminal of the seventh transistor and the second terminal of the eighth transistor.

16. The voltage reference circuit of claim 9, wherein the first negative temperature coefficient voltage is provided by a ninth transistor configured in the bandgap reference circuit; and the second negative temperature coefficient voltage is provided by a tenth transistor configured in the bandgap reference circuit.

17. The voltage reference circuit of claim 9, wherein the current inverter includes:

an eleventh transistor, having a first terminal coupled to the power supply, a second terminal coupled to the first compensation feedback current from the compensation controller, and a control terminal; and a twelfth transistor, having a first terminal coupled to the power supply, a second terminal for providing the second compensation feedback current to the bandgap reference circuit, and a control terminal coupled to the control terminal of the eleventh transistor and the second terminal of the twelfth transistor.

* * * * *